US011641997B2

(12) United States Patent
Evans et al.

(10) Patent No.: US 11,641,997 B2
(45) Date of Patent: May 9, 2023

(54) VACUUM-ASSISTED POPCORN CEILING SCRAPER

(71) Applicant: PBJT Engineering Solutions LLC, Chapin, SC (US)

(72) Inventors: Paul Evans, Chapin, SC (US); Jared Jeffcoat, Lexington, SC (US); Travis Murphy, Cayce, SC (US); Brent Jeffcoat, Lexington, SC (US)

(73) Assignee: PBJT Engineering Solutions LLC, Chapin, SC (US)

( * ) Notice: Subject to any disclaimer, the term of this patent is extended or adjusted under 35 U.S.C. 154(b) by 55 days.

(21) Appl. No.: 17/368,892

(22) Filed: Jul. 7, 2021

(65) Prior Publication Data

US 2021/0330162 A1 Oct. 28, 2021

Related U.S. Application Data

(63) Continuation of application No. 16/018,871, filed on Jun. 26, 2018, now Pat. No. 11,089,934.

(60) Provisional application No. 62/537,055, filed on Jul. 26, 2017.

(51) Int. Cl.

| | |
|---|---|
| ***A47L 11/38*** | (2006.01) |
| ***A47L 9/02*** | (2006.01) |
| ***A47L 11/40*** | (2006.01) |
| ***A47L 13/08*** | (2006.01) |
| ***B08B 1/00*** | (2006.01) |
| ***B08B 5/02*** | (2006.01) |

(52) U.S. Cl.

CPC ..... *A47L 11/38* (2013.01); *A47L 9/02* (2013.01); *A47L 11/4044* (2013.01); *A47L 11/4075* (2013.01); *A47L 11/4094* (2013.01); *A47L 13/08* (2013.01); *B08B 1/005* (2013.01); *B08B 5/02* (2013.01)

(58) Field of Classification Search

None

See application file for complete search history.

(56) References Cited

U.S. PATENT DOCUMENTS

| | | | |
|---|---|---|---|
| 5,047,089 | A | 9/1991 | Grant |
| 5,184,372 | A | 2/1993 | Mache |
| 5,419,007 | A | 5/1995 | Hult et al. |
| 6,101,663 | A | 8/2000 | Greer, Jr. et al. |
| 6,467,124 | B1 | 10/2002 | Small |
| 6,601,266 | B1 | 8/2003 | Faraci et al. |
| 7,661,175 | B2 | 2/2010 | Hollis |
| 7,814,609 | B1 | 10/2010 | Shumway |
| 8,108,966 | B1 | 2/2012 | Viviano |

(Continued)

OTHER PUBLICATIONS

Screen shot of Oneida Air Systems AXS001160 Viper Scraper Hand Tool; https://www.amazon.com/gp/product/B011IYE8EK?pf_rd_r=C7KX69F4NHPQ3YTXPX8N&pf; 1 page.

*Primary Examiner* — Brian D Keller

(74) *Attorney, Agent, or Firm* — Thrive IP

(57) ABSTRACT

A popcorn ceiling scraper includes a scraping head with multiple blades, at least one of which is oriented horizontally in the same plane as the scraping head with other blades extending vertically from the scraping head. The ceiling scraper has a funnel arranged below the scraping head, and the funnel and the scraping head are formed to reach to an edge or juncture between a ceiling and a wall.

17 Claims, 7 Drawing Sheets

(56) References Cited

U.S. PATENT DOCUMENTS

| | | | | |
|---|---|---|---|---|
| 9,435,120 | B2 | 9/2016 | Hanson et al. | |
| D789,634 | S | 6/2017 | Witter et al. | |
| 9,782,048 | B2 | 10/2017 | Witter et al. | |
| 2009/0070955 | A1* | 3/2009 | Hollis | A47L 7/0009 15/415.1 |
| 2009/0188920 | A1 | 7/2009 | Momberger | |
| 2016/0029867 | A1 | 2/2016 | Brown | |
| 2017/0035264 | A1 | 2/2017 | Brogan | |
| 2018/0110385 | A1* | 4/2018 | Buss | A47L 11/4044 |

* cited by examiner

VACUUM-ASSISTED POPCORN CEILING SCRAPER

CROSS-REFERENCE TO RELATED APPLICATIONS

This continuation patent application claims priority to U.S. Utility patent application Ser. No. 16/018,871, filed in the United States Patent and Trademark Office on Jun. 26, 2018, which claims benefit of U.S. Provisional Patent Application Ser. No. 62/537,055, filed in the United States Patent and Trademark Office on Jul. 26, 2017, both of which are incorporated herein in their entireties by reference thereto.

BACKGROUND OF THE DISCLOSURE

A "popcorn ceiling" or "cottage cheese ceiling" is a spray-on ceiling treatment that has been commonly used in residential construction since the 1950s. Popcorn ceilings are favored to hide imperfections and for their acoustical characteristics, and they are a quick way to finish ceilings. However, such ceilings trap dust and dirt and are difficult to clean due to their uneven surfaces and are difficult to repair. Moreover, popcorn finishes applied before the 1980s often contain asbestos.

Many owners desire to remove old popcorn ceilings in their homes or businesses. The most common method is to scrape away the popcorn ceiling treatment. Sometimes a popcorn ceiling will be sprayed with water or other preparation liquid to loosen the treatment, but this can cause absorption problems that lead to expansion and cracks in the ceiling and can be messy. Alternatively, the popcorn ceiling can be scraped by hand using a utility or drywall knife. Hand scraping, however, is time-consuming and often results in gouges in the ceiling and other damage that must be subsequently repaired, which requires more time and increases expense. Moreover, if there is asbestos or lead in older treated ceilings, the person scraping the ceiling may be exposed to toxic dust or particulates for an extended period of time.

Scraping devices have been introduced to remove popcorn ceilings using long handles and vacuums. However, known devices do not break-up the popcorn treatment into sufficiently manageable pieces. Also, conventional devices have a single blade that shaves away relatively large sections of the popcorn treatment, which break apart and fall to the floor before a catch or vacuum bag can receive the removed popcorn material. Moreover, the blades of known devices tend to gouge the ceiling and are not constructed to reach into corners and along edges, which therefore require subsequent, extensive hand-scraping.

What is needed in the remodeling and renovation industry is a system for removing popcorn treatments more efficiently without requiring excessive hand-scraping and clean-up and without damage to the underlying ceiling.

BRIEF SUMMARY

The present disclosure is directed in general to devices for scraping popcorn treatment from ceilings, including edges and corners.

The present disclosure includes a ceiling scraper that may have a scraping head with multiple blades extending therefrom. At least one of the blades may be oriented horizontally or in the same plane as the scraping head. At least one other blade may be vertically arranged, or orthogonal, to the horizontal blade. The exemplary scraper may include a funnel attached to the scraping head with a disposal aperture therethrough, and a handle for pressing the scraping head against a ceiling to remove a surface treatment therefrom, the surface treatment being scraped by the horizontal blade and directed therefrom into the orthogonal blade.

Other embodiments include the foregoing and other elements and steps described herein, and their equivalents, in various combinations.

Additional objects and advantages of the present subject matter are set forth in, or will be apparent to, those of ordinary skill in the art from the description herein. Also, it should be further appreciated that modifications and variations to the specifically illustrated, referenced, and discussed features, processes, and elements hereof may be practiced in various embodiments and uses of the disclosure without departing from the spirit and scope of the subject matter. Variations may include, but are not limited to, substitution of equivalent means, features, or steps for those illustrated, referenced, or discussed, and the functional, operational, or positional reversal of various parts, features, steps, or the like. Those of ordinary skill in the art will better appreciate the features and aspects of the various embodiments, and others, upon review of the remainder of the specification.

BRIEF DESCRIPTION OF THE DRAWINGS

A full and enabling disclosure of the present subject matter, including the best mode thereof, directed to one of ordinary skill in the art, is set forth in the specification, which makes reference to the appended figures, in which.

DETAILED DESCRIPTION OF THE DISCLOSURE

Figure 1:
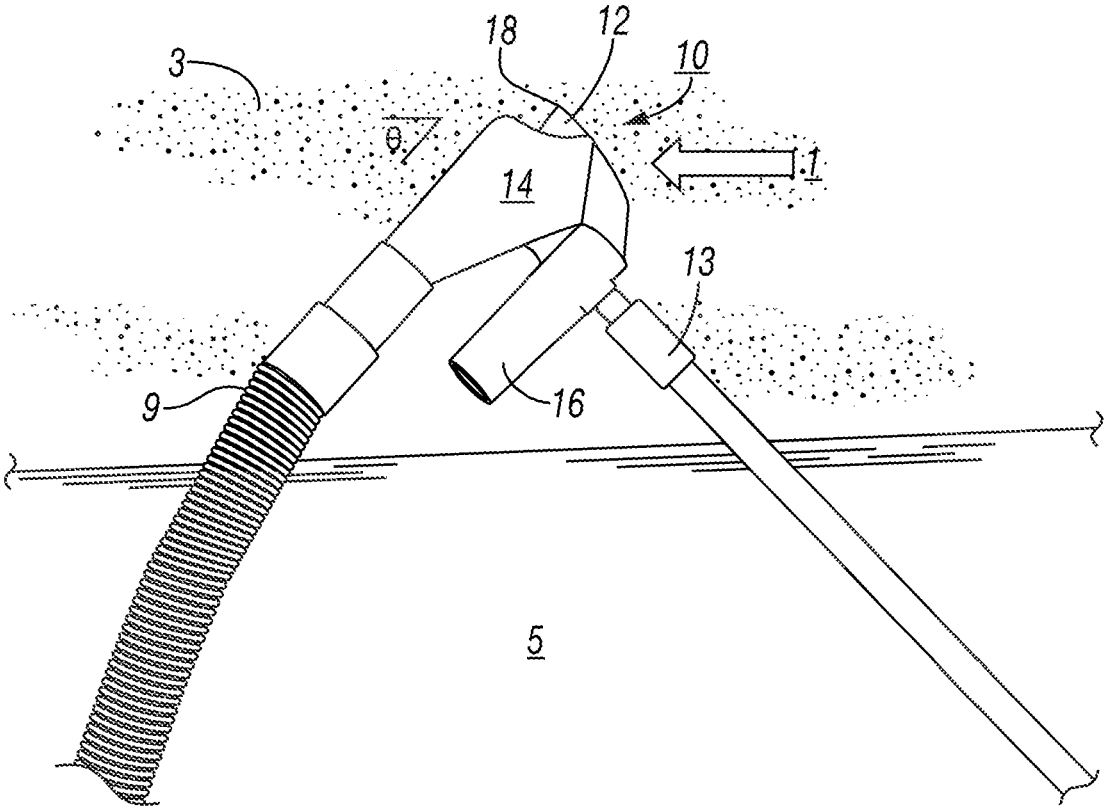
FIG. 1 is a perspective view of an embodiment in an intended use environment according to an aspect of the disclosure.

Detailed reference will now be made to the drawings in which examples embodying the present subject matter are shown. The detailed description uses numerical and letter designations to refer to features of the drawings. The drawings and detailed description provide a full and written description of the present subject matter, and of the manner and process of making and using various exemplary embodiments, so as to enable one skilled in the pertinent art to make and use them, as well as the best mode of carrying out the exemplary embodiments.

Although detailed embodiments are disclosed as required, it is to be understood that the embodiments are merely exemplary. The figures are not necessarily to scale, and some features may be exaggerated to show details of particular components. Therefore, specific structural and functional details disclosed herein are not to be interpreted as limiting, but merely as a basis for the claims and as a representative basis for teaching one skilled in the art to variously employ the various embodiments of the present disclosure. The present subject matter thus includes any modifications and variations of the following examples as come within the scope of the appended claims and their equivalents.

Unless defined otherwise, all technical and scientific terms used herein have the same meaning as is commonly understood by one of ordinary skill in the art to which this disclosure belongs. In the event that there is a plurality of definitions for a term herein, those in this section prevail unless stated otherwise.

Wherever the phrase "for example," "such as," "including," and the like are used herein, the phrase "and without limitation" is understood to follow unless explicitly stated otherwise. Similarly, "an example," "exemplary" and the like are understood to be non-limiting.

The term "substantially" allows for deviations from the descriptor that do not negatively impact the intended purpose. Descriptive terms are understood to be modified by the term "substantially" even if the word "substantially" is not explicitly recited.

The term "about" when used in connection with a numerical value refers to the actual given value, and to the approximation to such given value that would reasonably be inferred by one of ordinary skill in the art, including approximations due to the experimental and/or measurement conditions for such given value.

The terms "comprising," "including," "having," and "involving," (and similarly, "comprises", "includes," "has," and "involves") and the like are used interchangeably and have the same meaning. Specifically, each of the terms is defined consistent with the common United States patent law definition of "comprising" and is therefore interpreted to be an open term meaning "at least the following" and is also interpreted not to exclude additional features, limitations, aspects, et cetera. Thus, for example, "a device having components "a, b, and c" means that the device includes at least components a, b and c. Similarly, the phrase: "a method involving steps a, b, and c" means that the method includes at least steps a, b, and c.

Unless the context clearly requires otherwise, throughout the description and the claims, the words "comprise," "comprising," and the like are to be construed in an inclusive sense as opposed to an exclusive or exhaustive sense; i.e., in the sense of "including, but not limited to".

Any discussion of prior art in the specification should in no way be considered as an admission that such prior art is widely known or forms part of common general knowledge in the field.

The various embodiments of the disclosure and/or equivalents falling within the scope of present disclosure overcome or ameliorate at least one of the disadvantages of the prior art, or provide a useful alternative.

Turning now to FIG. 1, a popcorn ceiling scraping system according to an aspect of the disclosure is designated in general by the number 10. The system 10 broadly includes a blade or cutting head 12, a scoop or funnel 14, and a handle or grip 16. The exemplary blade 12 may include a first leading or cutting edge 18 and be made from plastic such as high-density polyethylene (HDPE), metal, or other durable but preferably light weight material. The scoop 14 and the handle 16 may be formed from injection-molded plastic to accommodate various shapes as detailed below. As shown, the blade 12 is connected to the scoop 14 to scrape a popcorn treatment 3 from a ceiling 1 surrounded by walls 5. Also, a vacuum hose 9 can be connected to the system 10 to assist in removing the treatment 3 from the ceiling 1, which in this example is being scraped in a direction marked by the large arrow, similar to mowing a lawn. Here, popcorn treatment 3, some partially removed, surrounds a cleared area of the ceiling 1 that has been scraped and vacuumed by the system 10. The handle 16, in this example, can be held by an operator to press the blade 12 along the ceiling 1 at an angle θ of approximately thirty degrees (30°) relative to the ceiling 1. Additionally, or alternatively, a rod or pole 13 can be connected to the handle 16 to achieve the optimum angle θ without requiring the operator to stand on a ladder to reach the ceiling 1.

Figure 2:
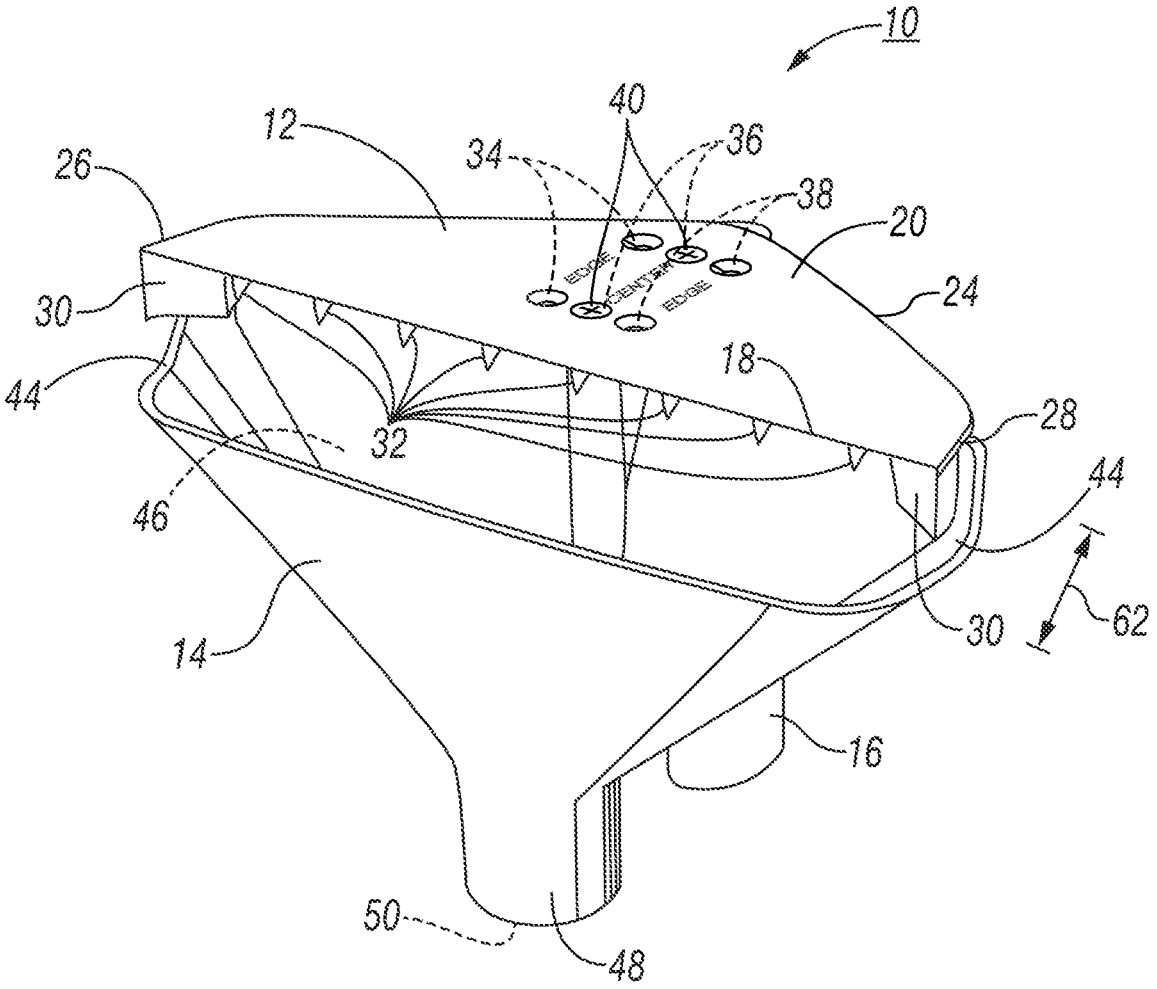
FIG. 2 is a top perspective view of the embodiment as in FIG. 1.

Turning to FIG. 2, the blade 12, the scoop 14, and the handle 16 of the system 10 are most clearly shown. The blade 12 may include the cutting edge 18 briefly introduced above, an upper or top surface 20, a bottom or interior surface 22, a second or trailing edge 24, a left, angled or beveled edge 26, and a right, angled or beveled edge 28. The leading edge 18 may be formed unitarily with the blade 12 and may define a sharpened edge, or the edge 18 may be a separate metal strip attached to the blade 12. As will be explained in greater detail below, the angled edges 26, 28 permit the blade 12 to better reach into corners and along edges of ceilings 1 and walls 5 (see FIG. 1). In this example, one or more angled side scoops or guide vanes 30 assist in directing larger, shaved swaths of popcorn treatment toward and into a series of substantially vertically disposed blades 32 as well as into a mouth or entryway 46 of the scoop 14. These features are also discussed in more detail below.

As further shown in FIG. 2, a plurality of holes or apertures may be formed in and through the surface 20. More particularly, one or more left apertures or screw holes 34, middle apertures or screw holes 36, and right apertures or screw holes 38 are provided to accommodate adjustment and retaining fasteners or devices 40 such as screws. In this example, the fasteners 40 are brass and are secured into the middle holes 36, which may be labeled "center," that serve to center the blade 12 for most ceiling work. When edging is required, the fasteners 40 may be removed and reinserted in the left screw holes 34 or in the right screw holes 38 (which may be labeled "edge") to laterally adjust the blade 12 either to the left or to the right. Those skilled in the art will understand that the terms left and right are merely used in this example to differentiate different sides and are not intended to limit the embodiments to the examples shown. Moreover, one of ordinary skill in the art will understand that ratchet mechanisms, a sliding bar, or other adjustment arrangements other than screws 40 may be used to reposition the blade 12 relative to the scoop 14.

With reference to both FIGS. 1 and 2, the mouth 46 is shown extending beyond the edge 18 by a distance 62. This exemplary arrangement permits the scoop 14 to better catch stray pieces of the popcorn treatment 3 as it falls away from the ceiling 1. Additionally, as briefly introduced above, the chamfered edges 26, 28 cooperate with flared sidewalls 44 of the scoop 14 to better catch the popcorn treatment 3 near edges of ceilings 1 and walls 5. More specifically, the edges 26, 28 and the sidewalls 44 enable the system 10 to reach into tight or restricted areas of ceilings 1 and walls 5 such as edges and corners thereby obviating the need to hand-scrape those confined areas.

FIG. 2 also shows that the scoop 14 may include a vacuum hose connection or attachment nozzle 48 arranged near the handle 16. The vacuum connection 48 has a conduit or hole 50 through which shredded popcorn treatment 3 falls from the mouth 46 of the scoop 14. Although a vacuum is not required, a connected suction force will assist in attracting scraped and loosened popcorn treatment 3 from the ceiling 1 as shown in FIG. 1 and will more quickly remove the popcorn treatment 3 from the scoop 14.

Figure 3:
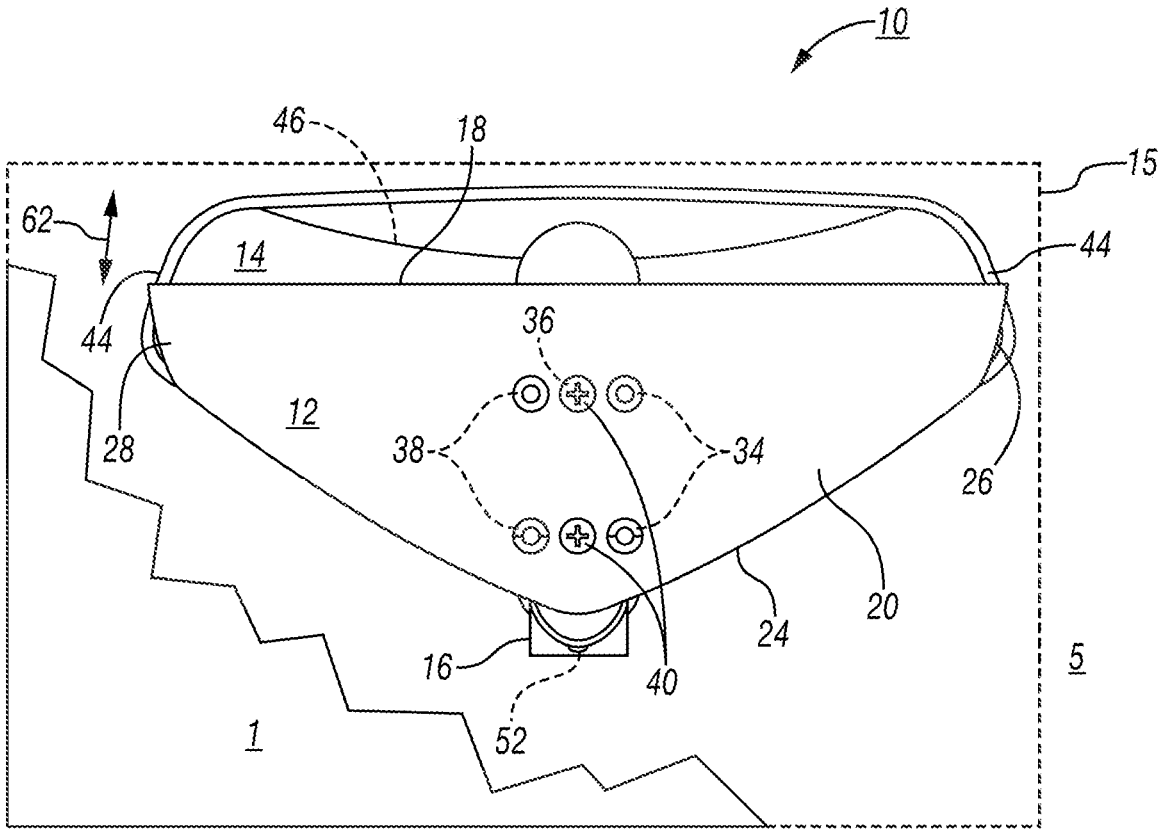
FIG. 3 is a top plan, partially broken, view of the embodiment as in FIG. 1.

Turning now to FIG. 3, this top-down view of the system 10 (viewed through a partially broken ceiling 1 for discussion purposes) most clearly shows features of the blade 12, the scoop 14, and the handle 16. Here, an opening or receptacle 52 for the rod or pole 13 introduced in FIG. 1 is partially shown in the handle 16. Additionally, the blade 18, the trailing edge 24, and the angled sides 26, 28 of the blade 12 are shown relative to the scoop 14 and to a juncture or edge 15 of the ceiling 1 and the wall 5. The distance 62 between a front edge of the mouth 46 and the cutting edge 18, and the flared sidewalls 44 of the scoop 14 are also most clearly shown in FIG. 3.

Still further, FIG. 3 shows the holes 34, 36, 38 and the movable fasteners 40. Again, in this example, the fasteners 40 are inserted into the middle holes 36 to center the blade 12 relative to the scoop 14. As described by example operation below, if close-in ceiling edging is required, the fasteners 40 can removed and inserted into either of the other holes 34, 38. The alternative left or right positions permit the vanes 30 (see FIG. 2) to extend into corners or edges for better removal of popcorn treatment.

Figure 4A:
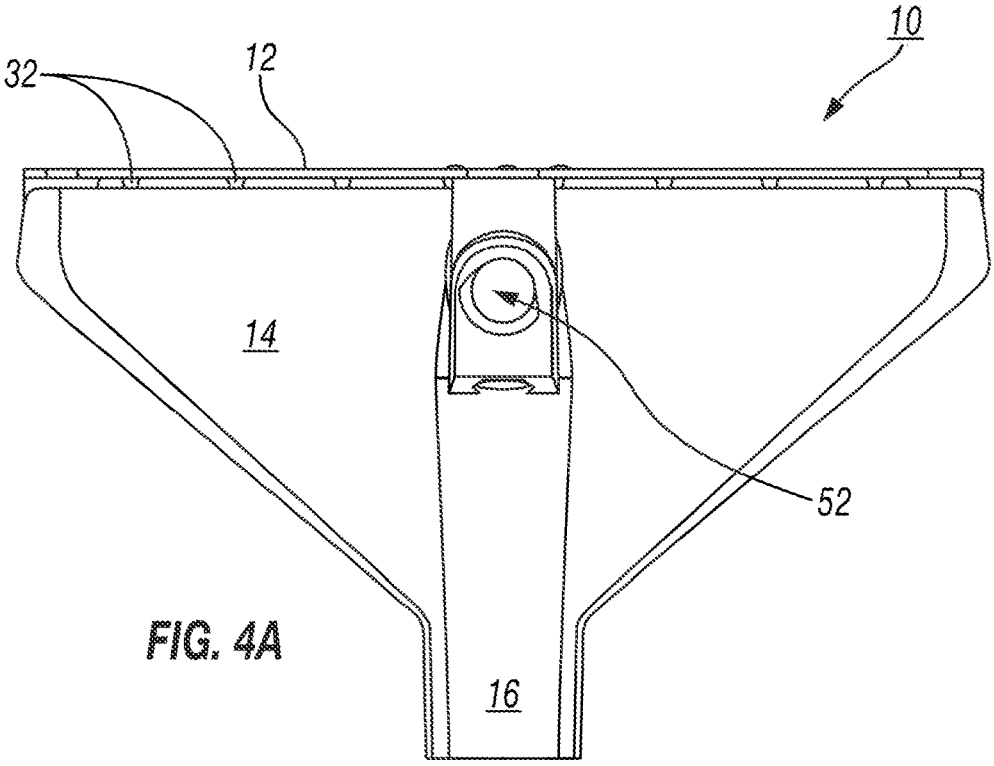
FIG. 4A is a rear elevational view of the embodiment as in FIG. 1.
Figure 4B:
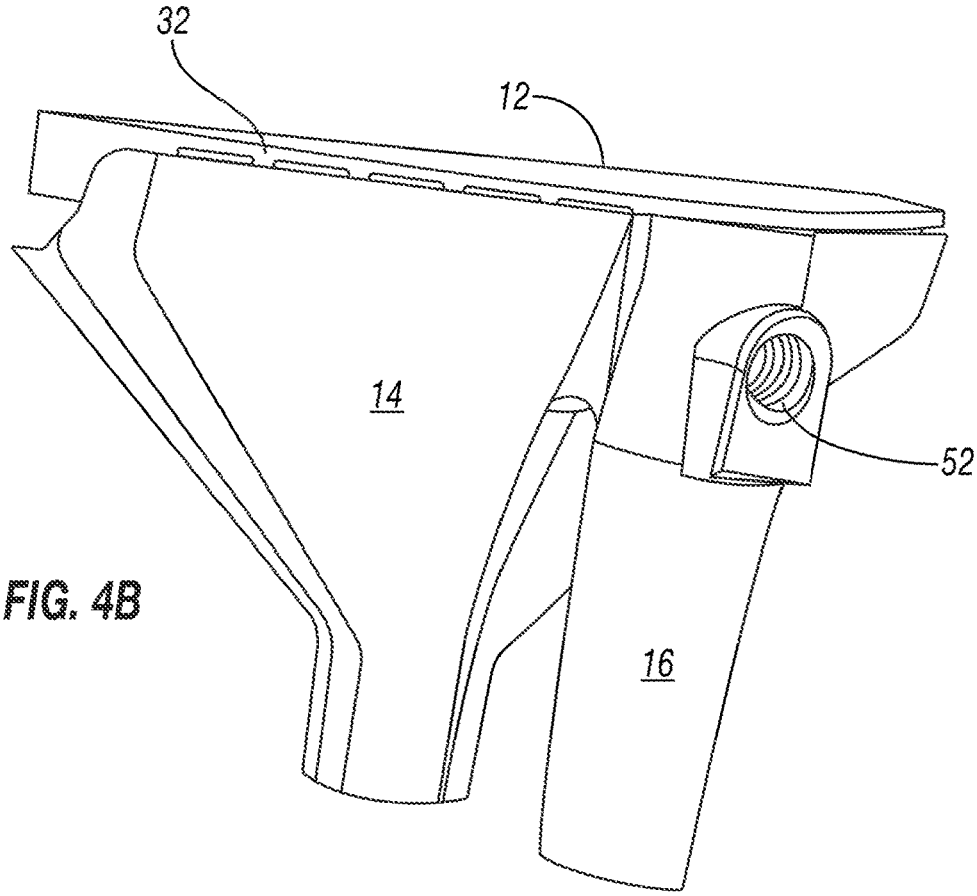
FIG. 4B is a rear, perspective view of the embodiment as in FIG. 1.

FIGS. 4A and 4B again show the system 10 and its blade 12, the scoop 14, and the handle 16 with the receptacle 52 for the pole 13 (see FIG. 1). In this example, the receptacle 52 is threaded, but it may be a ball joint receptacle or the like to permit the pole 13 to be adjusted during operation. Also shown in FIGS. 4A and 4B are the vertical blades 32, which assist in breaking up sections of popcorn material 3 to facilitate vacuuming and removal. The blades 32 may be tapered from near the blade 12 to a point and also tapered from wide to narrow in a direction of the trailing edge 24 of the scoop 14 (see FIG. 1) in order to break apart larger pieces of removed popcorn material 3. In this example, there are eight (8) vertically disposed, substantially equally spaced blades 32, but there may be fewer or additional blades 32, and they can be spaced closer together nearer the middle of the blade 12 and farther apart in a direction of the outer parts of the blade 12.

Figure 5B:
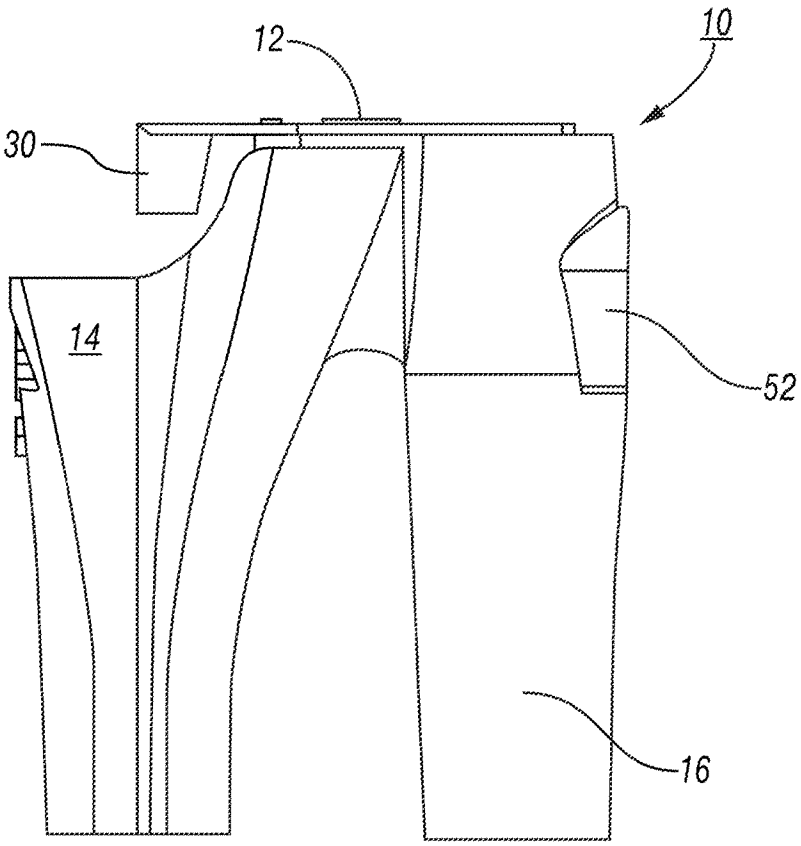
FIG. 5B is a left side, elevational view of the embodiment as in FIG. 1.
Figure 5A:
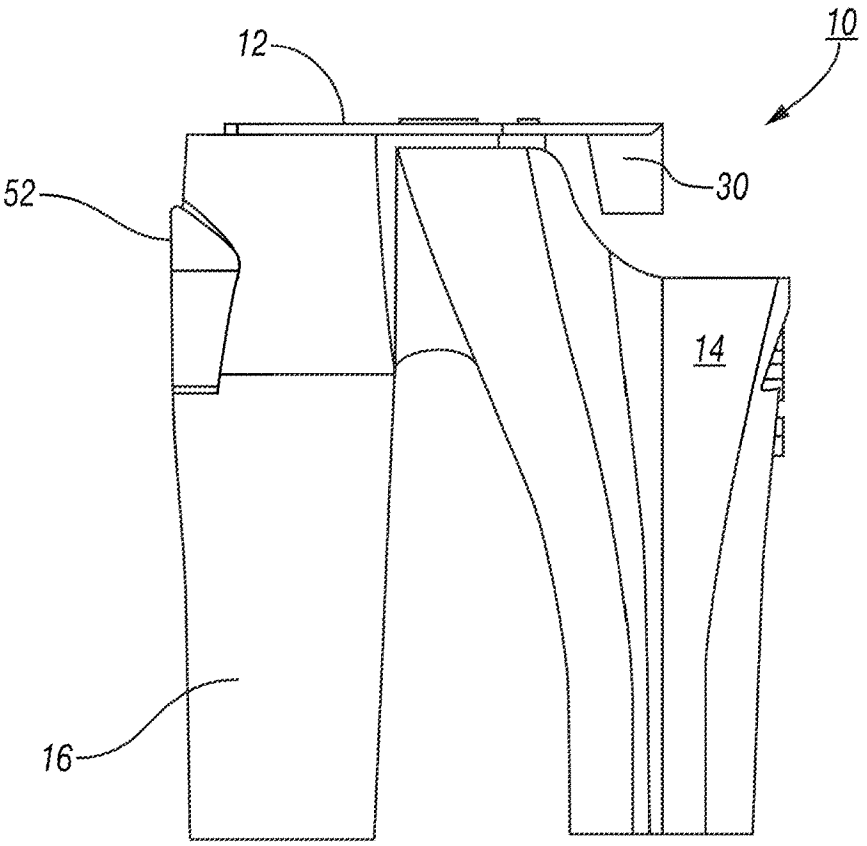
FIG. 5A is a right side, elevational view of the embodiment as in FIG. 1.

FIGS. 5A and 5B shows the system 10 and its blade 12, the scoop 14, and the handle 16 from each side. Similar to FIGS. 4A and 4B, the receptacle 52 can be arranged in the handle 16 to receive the pole 13 (see also FIG. 1), although the disclosure is not limited to that exemplary arrangement. Also, the vanes 30 are most clearly shown above the scoop 14 in FIGS. 5A and 5B.

Figure 6:
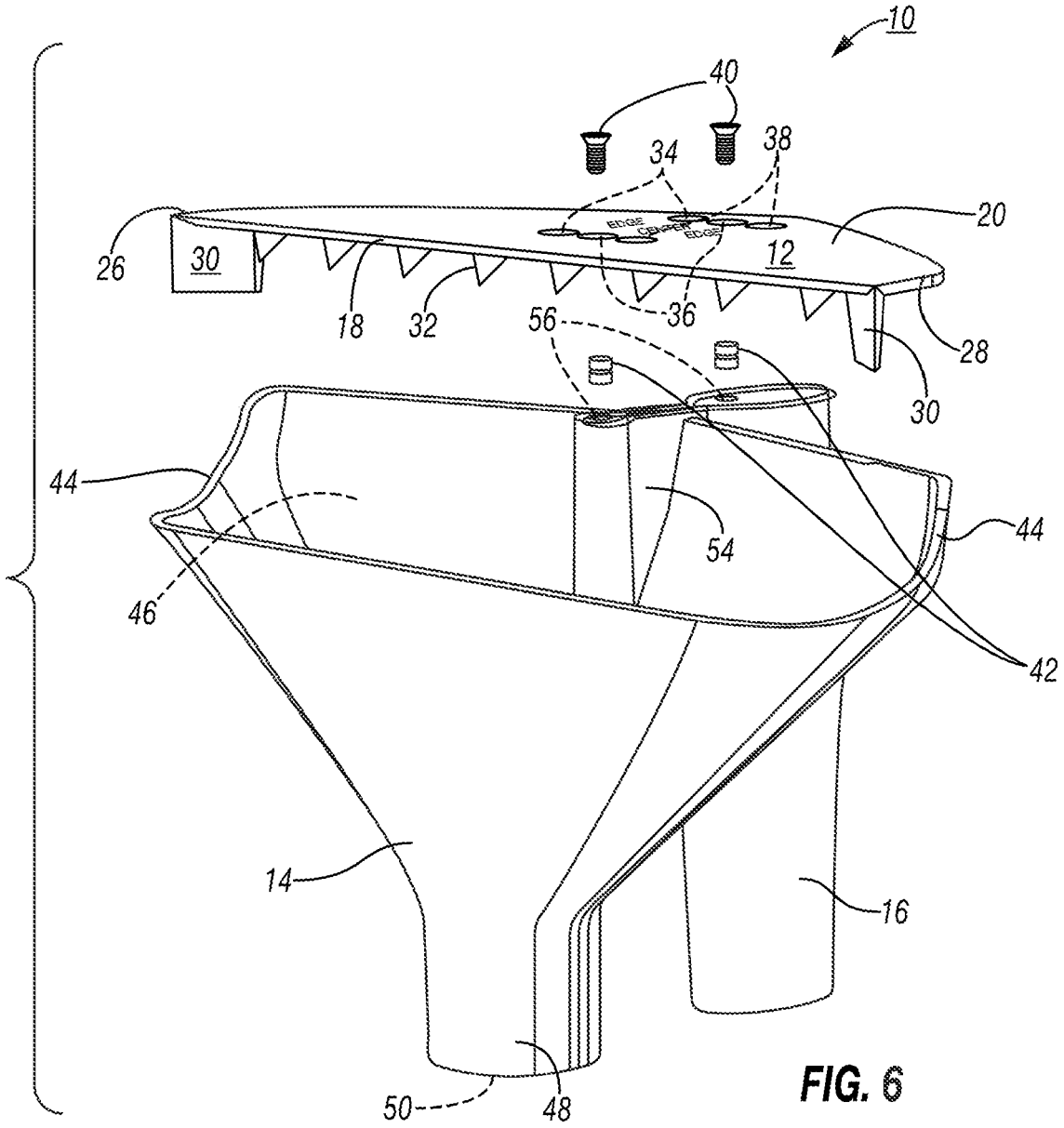
FIG. 6 is an exploded, perspective view of the embodiment as in FIG. 2.

FIG. 6 again shows the exemplary components of the system 10 including the blade 12, the scoop 14, and the handle 16. FIG. 6 is similar to FIG. 2 except that the components are spaced apart for clarity. More particularly, the fasteners 40 introduced above are separated from respective inserts 42 that in turn are molded or anchored into a stabilizing or load-bearing rib 54. The inserts 42, like the fasteners 40, may be brass or other durable, rust-free material. In operation, the blade 12 has some flexibility as its leading edge 18 scrapes along a popcorn ceiling. This flexibility accommodates uneven popcorn ceiling surfaces. The rib 54 ensures that the blade 18 maintains relatively even pressure in its center area against the ceiling as the outer edges 26, 28 float to some degree to prevent gouging; i.e., the blade 18 contours to the ceiling 1. Thus, the rib 54 ensures that the system 10 can be used effectively by most anyone regardless of different techniques, skill levels, and applied pressures.

Figure 7:
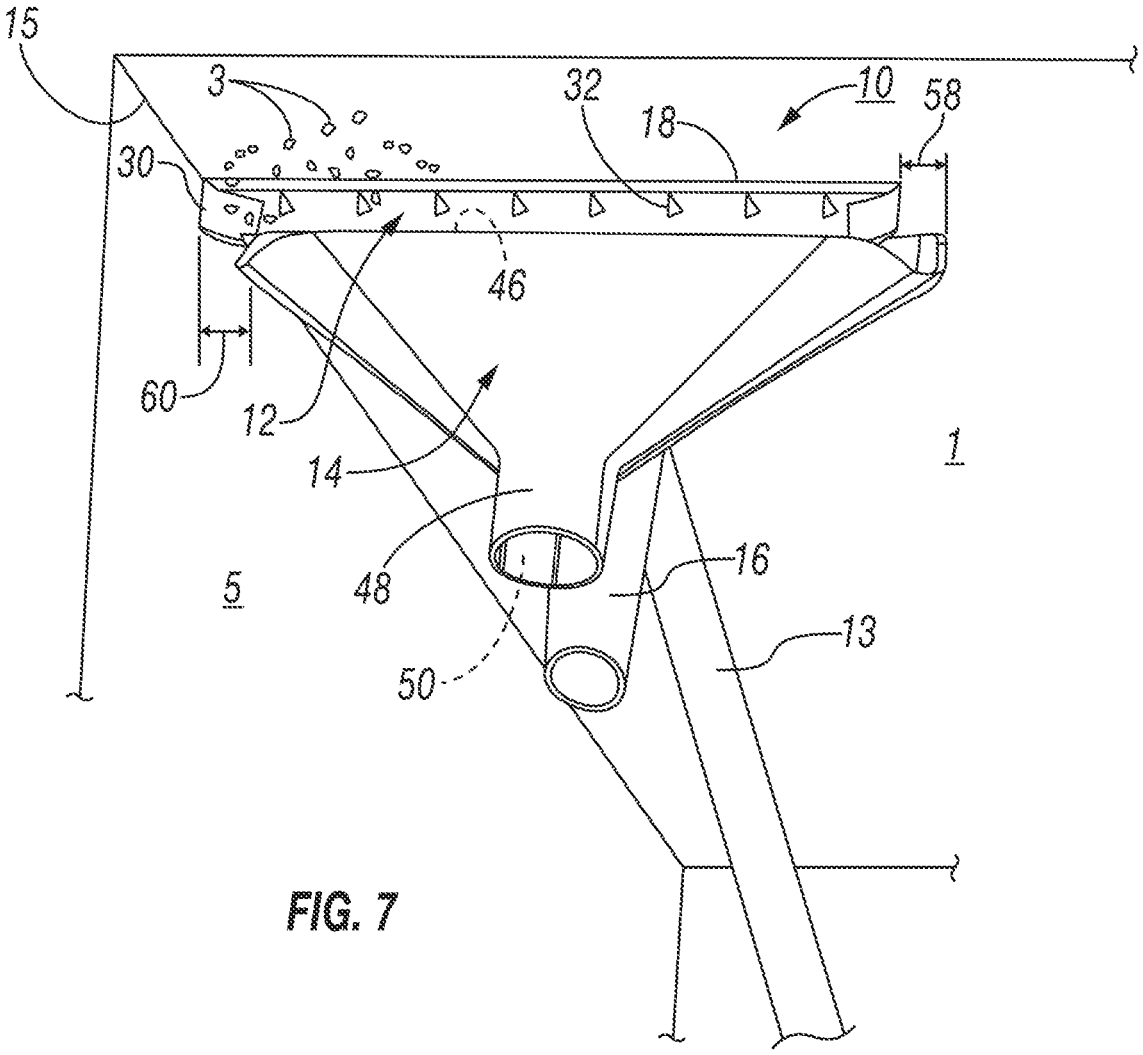
FIG. 7 is a perspective view of the embodiment as in FIG. 1, particularly showing an edging adjustment according to another aspect of the disclosure.

With reference to FIG. 7, the blade 12 of the system 10 has been adjusted to the left relative to the scoop 14 as indicated by gap or distances 58, 60. The handle 16, shown near the vacuum attachment 48 with opening 50, or rod 13 can be used to press the blade 12 at approximately twenty degrees (20°) to about forty degrees (40°), more particularly, at approximately thirty degrees (30°) against the ceiling 1 to break up the popcorn treatment 3 (see FIG. 1). For clarity, a vacuum hose is not shown in FIG. 7, but one may be connected between a shop vacuum (not shown) and the attachment 48 to suction away the removed pieces of popcorn treatment 3 after being scraped by the edge 18, broken up by the blades 32, and deposited into the mouth 46 of the scoop 14. Because the blade 18 can be moved toward the wall 5 as indicated by adjustments 58, 60 and because the vane 30 angles toward the mouth 46, the system 10 can clean the popcorn ceiling 1 up to the juncture 15 between the ceiling 1 and the wall 5.

While the present subject matter has been described in detail with respect to specific embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

That which is claimed is:

1. A ceiling scraper, comprising:

a scraping head having a plurality of blades extending therefrom and a vane disposed proximate the blades, at least one blade of the plurality of blades being substantially orthogonally disposed relative to the scraping head and at least one other blade being horizontally disposed relative to the scraping head, the orthogonally disposed blade depending from the substantially horizontally blade;

a funnel attached to the scraping head, the funnel having a disposal aperture therethrough forming a flared sidewall disposed proximate the vane; and a handle for pressing the scraping head against a ceiling having an uneven surface treatment thereon such that by applying pressure to the handle the blades are caused to remove the uneven surface treatment from the ceiling, the surface treatment being directed by the vane at the flared sidewall into the funnel.

2. The ceiling scraper as in claim 1, wherein the vane is disposed at an angle relative to at least one of the blades.

3. The ceiling scraper as in claim 1, wherein the flared sidewall is configured to reach a wall and ceiling juncture.

4. The ceiling scraper as in claim 1, wherein the disposal aperture is in communication with a vacuum, the vacuum being configured to pull the removed surface treatment from the funnel.

5. The ceiling scraper as in claim 1, further comprising a rib disposed in the funnel, the rib being configured to reinforce the scraping head as the blades contact the uneven surface treatment on the ceiling.

6. The ceiling scraper as in claim 1, wherein the vane further comprises at least two vanes disposed at angles relative to respective blades.

7. A ceiling scraper, comprising:

a scraping head having a plurality of blades extending therefrom, at least one of the blades being oriented horizontally and at least one other blade being disposed orthogonally to the horizontal blade, the orthogonally disposed blade extending from the horizontally oriented blade;

a funnel attached to the scraping head, the funnel having a disposal aperture therethrough; and a handle for pressing the scraping head against a ceiling to remove an uneven surface treatment therefrom, the surface treatment being scraped by the horizontal blade from the ceiling and directed therefrom into the orthogonal blade, the orthogonal blade being configured to break a swath of the removed surface treatment into smaller pieces for deposit into the funnel and removal through the disposal aperture.

8. The ceiling scraper as in claim 7, wherein one of the scraping head and the horizontal blade is laterally adjustable to reach a wall and ceiling juncture.

9. The ceiling scraper as in claim 7, wherein the horizontal blade is in a same plane as the scraping head.

10. The ceiling scraper as in claim 7, wherein the orthogonally disposed blade includes two to eight blades depending vertically from the scraping head.

11. A ceiling scraper, comprising:

a scraping head having a plurality of blades extending therefrom, at least one of the blades being oriented substantially horizontally and at least one other blade being disposed substantially orthogonally to the horizontal blade;

a funnel attached to the scraping head, the funnel having a disposal aperture therethrough;

at least two vanes disposed about the disposal aperture proximate the blades; and a handle for pressing the scraping head against a ceiling to remove an uneven surface treatment therefrom, the surface treatment being scraped by the horizontally oriented blade from the ceiling and being directed therefrom into the orthogonal blade at least in part by the vanes, the orthogonal blade being configured to break a swath of the removed surface treatment into smaller pieces for deposit into the funnel and removal through the disposal aperture.

12. The ceiling scraper as in claim 11, wherein one of the scraping head and the substantially horizontally oriented blade includes means for lateral adjustment to reach a wall and ceiling juncture.

13. The ceiling scraper as in claim 12, wherein the means for lateral adjustment are movable fasteners.

14. The ceiling scraper as in claim 11, wherein the plurality of blades includes two to eight blades with a leading edge to assist in breaking the removed surface treatment into smaller pieces.

15. The ceiling scraper as in claim 11, wherein the funnel has a flared sidewall configured to reach a wall and ceiling juncture.

16. The ceiling scraper as in claim 11, wherein the vanes are disposed at angles relative to the orthogonally oriented blade.

17. The ceiling scraper as in claim 11, further comprising a vacuum attachment for connecting a vacuum to pull the removed surface treatment from the funnel.

* * * * *